United States Patent [19]

Suga

[11] 4,363,250

[45] Dec. 14, 1982

[54] DEVICE FOR DRIVING SCREW, PIN, RIVET OR THE LIKE

[76] Inventor: Asakichi Suga, 20-7,3-chome, Chuo, Ota-ku, Tokyo, Japan

[21] Appl. No.: 250,028

[22] Filed: Apr. 1, 1981

[30] Foreign Application Priority Data

Apr. 4, 1980 [JP] Japan ..... 55-45628[U]

[51] Int. Cl.[3] ..... B25B 23/10; B25C 3/00

[52] U.S. Cl. ..... 81/455; 81/453

[58] Field of Search ..... 81/455, 453; 227/149

[56] References Cited

U.S. PATENT DOCUMENTS

| | | | |
|---|---|---|---|
| 1,424,703 | 8/1922 | Work | 81/455 |
| 1,521,268 | 12/1924 | Arsenault | 81/455 |
| 3,965,950 | 6/1976 | MacDonald | 81/455 |
| 4,165,772 | 8/1979 | Suga | 81/453 |

*Primary Examiner*—Donald R. Schran
*Attorney, Agent, or Firm*—Cantor and Singer

[57] ABSTRACT

A device for driving a screw, pin, rivet or the like into a threaded or drilled hole is disclosed which is adapted to operate a nozzle comprising a pair of nozzle halves to pinch it. When driving a screw by means of the device as a screw driver, a thrust sleeve is displaced forwards by operating an E-shaped control lever on a stationary cylinder and thereby the nozzle halves are depressed at their rear parts so that they are opened. Then the screw to be driven is located in position midst the nozzle halves kept open and thereafter the control lever is restored to the original position. A press block is displaced forwards by means of a spring in the thrust sleeve and expands the nozzle halves, causing the nozzle to be opened to firmly hold the screw. By locating the nozzle with the screw held thereby just in front of a threaded hole and then lightly pushing a rotary cylinder, while rotating the same, a center rod is displaced forwards and thereby the thrust sleeve is in turn displaced forwards to depress the nozzle halves. As a result the nozzle is opened and disengaged from the screw and at the same time it is driven by the free end portion of the center rod. The control lever may be formed in a triangular shape in cross section and have a surface extension for easy operation by an operator's finger.

6 Claims, 7 Drawing Figures

DEVICE FOR DRIVING SCREW, PIN, RIVET OR THE LIKE

BACKGROUND OF THE INVENTION

1. Field of the Invention

The present invention relates to a device for driving a screw, pin, rivet or the like into a threaded or drilled hole and more particularly relates to a manually operated device well adapted for use in fine hand works such as for driving a screw into a threaded hole or inserting a pin or rivet into a drilled hole.

2. Description of the Prior Art

In manufacturing, assembling or disassembling a variety of small-sized precision instruments and machines such as watch, clock or the like a large number of pincette or similar tool for locating and driving a screw, pin, rivet or the like into a threaded or drilled hole. Since the conventional fine hand works are entirely dependent on an operator's skill, they are performed at lower working efficiency with a great deal of fatigue of the operator.

Hitherto various devices of the kind for driving a screw, pin, rivet or the like into a threaded or drilled hole have been already proposed. However it is pointed out as drawbacks with the conventional devices that they are very complicated in structure, are expensive to be manufactured and have few reliability of operation.

In view of the above mentioned drawbacks of the conventional devices to be eliminated, the inventor made an invention which consists in an improved device of the kind which is intended to be considerably simple in structure and have an excellent reliability of firmly holding and driving a screw, pin, rivet or the like in association with locking operation. A patent was granted to the prior invention under U.S. Pat. No. 4,165,772. The device in accordance with the prior invention essentially comprises a rotary cylinder to which a grip end cylinder is rotatably attached, a center rod with its end secured to the rotary cylinder and having thereon a stopper, a thrust sleeve disposed on the fore side of the stopper along the center rod and having an annular notch formed at the fore and part thereof, a cylindrical press block displaceably mounted on the center rod with a spring extending from the stopper, a stationary cylinder containing the thrust sleeve and press block therein, said stationary cylinder being telescopically fitted into the rotary cylinder so that a relative sliding movement as well as a relative rotational movement are ensured between the both stationary and rotary cylinders, a swing lever having a pin depending therefrom, a top cylinder connected to the stationary cylinder and having an aperture through which the pin passes, a support block disposed within the top cylinder and so shaped as to swing-movably carry a pair of nozzle halves, and a nozzle consisting of the aforesaid nozzle halves and having a hook formed on one of the nozzle halves, said hook being adapted to be engaged to the annular notch in the thrust sleeve.

In fact the device of the prior invention succeeded in eliminating the drawbacks inherent to the conventional one, but it has been considered as another drawback to be eliminated that operation of the swing lever for controlling opening and closing of the nozzle is associated with locking movement of the thrust sleeve in a complicated manner.

SUMMARY OF THE INVENTION

Hence the present invention is intended to improve the device of the prior art in such a manner that a control lever and associated components are more simply constructed and ensure more reliable locking movement. The device in accordance with the present invention has no necessity for any annular notch formed in the front part of the thrust sleeve as well as any hook at the rear parts of the nozzle halves which are adapted to be engaged to the aforesaid annular groove, resulting in easy manufacturing of the device at an inexpensive cost.

Specifically the improved device of the invention is constructed such that a screw, pin, rivet or the like is screwed or inserted into a threaded or drilled hole by locating the nozzle just in front of the hole with the screw held by means of a pair of nozzle halves in the form of bird's bill and lightly pushing the device toward the hole, while rotating the same. The device in accordance with a preferred embodiment of the invention essentially comprises a hollow stationary cylinder, a rotary cylinder to which a grip end cylinder is rotatably attached, said rotary cylinder being telescopically fitted on the stationary cylinder, a center rod with its one end secured to the rotary cylinder, having a collar at the middle part and an axial extension in reduced diameter, a thrust sleeve axially displacably arranged in front of the collar, said thrust sleeve being formed with an inner tapered part around its front edge and a locking recess in position on the outer surface thereof, a conical headed press block axially displaceably arranged on the axial extension of the thrust sleeve to move forward by means of a spring means, a nozzle comprising a pair of nozzle halves, each of which has an inclined rear part which is so formed as to come in engagement to the inner tapered of the thrust sleeve on its outer side and to the conical headed part of the press block on its inner side, a support block arranged on thefront part of the axial extension of the center rod to carry the nozzle and a control lever in the form of twin lever arms pivotally arranged in position on the stationary cylinder.

Said control lever is formed in an E-shaped cross section, one of the lever arms extending through an aperture on the stationary cylinder to the thrust sleeve to displace the same forwards by means of its tapered end, while the other lever arm extending through another aperature to a recess formed on the thrust sleeve to lock the same by means of its tapered end. Further control lever is provided with a spring means disposed about the former lever arm to ensure return movement thereof.

In accordance with a modified embodiment of the invention the control lever is formed in a triangular cross section and has an extension from the upper inclined surface to ensure easy operation by an operator's finger, wherein a spring means is arranged about a pivotal pin for return movement of the control lever.

When driving a screw into a threaded hole, the free end of the center rod is formed to the shape of a screw driver.

When inserting a pin or rivet into a drilled hole, the free end of the center rod is formed to a flat end face against which the pin or rivet is adapted to abut.

In order to make it easy to hold or pinch a screw, pin, river or the like, it is preferable that the respective nozzle halves are made of split tube in semi-circular section and are beveled at one corner edge of the tip portion thereof.

Thus it is an object of the present invention to provide an improved device for driving a screw, pin, rivet or the like into a threaded or drilled hole, which is capable of reliably holding or pinching it.

It is other object of the invention to provide the device which has no possibility that a screw, pin, rivet or the like to be driven falls down, when locating the nozzle at any position in any direction and thus can be operated in any working place.

It is another object of the invention to provide the device which is considerably simple in structure, is easy to be operated and is manufactured at an inexpensive cost.

Other objects and advantageous features of the invention will be obvious from the following description.

BRIEF DESCRIPTION OF THE ACCOMPANYING DRAWINGS

Now the present invention will be described in more details with reference to the accompanying drawings which illustrate a device in accordance with preferred embodiments of the invention, in which.

It is to be noted that the same or similar parts and components are given the same reference numerals throughout the drawings.

DETAILED DESCRIPTION OF THE PREFERRED EMBODIMENTS

Figure 1:
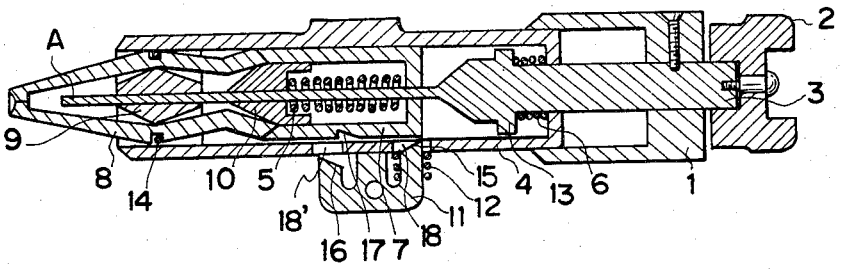
FIG. 1 is a sectional view of the device which is constructed as a screw driver, taken in the longitudinal direction, wherein the parts and components incorporated in the device are shown in an inoperative position.
Figure 2:
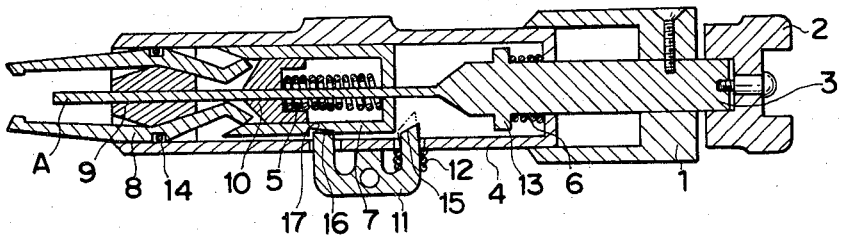
FIG. 2 is a sectional view of the device in FIG. 1, wherein the nozzle in the form of bird's bill is opened by operating the control lever to displace the thrust sleeve forwards.
Figure 3:
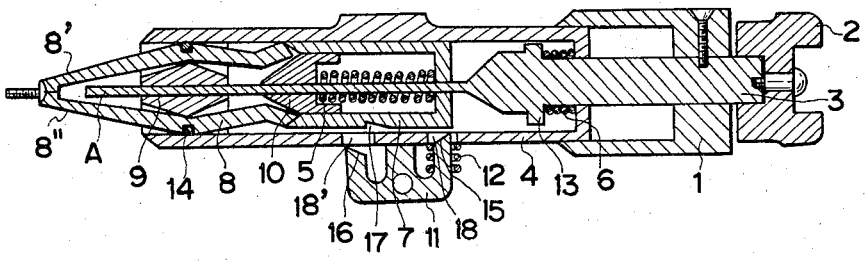
FIG. 3 is a sectional view of the device in FIG. 1, wherein the nozzle is holding a screw between the both upper and lower nozzle halves.
Figure 4:
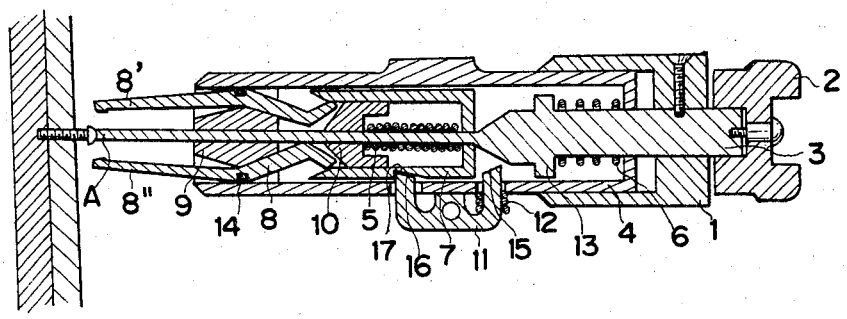
FIG. 4 is another sectional view of the device in FIG. 1, wherein the center rod is displaced forwards and then the free end of the center rod is carrying out driving operation with the both nozzle halves kept open.

Referring to FIGS. 1 to 4, the device of the invention designed and constructed as a screw driver essentially comprises a rotary cylinder 1 closed at its rear end and opened at its front end, a grip end cylinder 2 rotatably supported at the rear end of the rotary cylinder 1, a center rod 3 axially extending from the rear end of the rotary cylinder 1 toward the free and thereof, said free end being formed to a positive shape corresponding to the recessed part of the screw head, a stationary cylinder 4 rotatably and axially displaceably carrying the rotary cylinder 1 telescopically fitted thereon, a thrust sleeve 7 axially displaceably arranged in the stationary cylinder 4, a nozzle 8 located in the fore part of the stationary cylinder 4, consisting of a pair of upper and lower nozzle halves 8' and 8'' which are adapted to be operated just like a bird's bill by means of the thrust sleeve 7, a support block 9 located in the fore part of the stationary cylinder 4 for operatively supporting and guiding the nozzle 8 so as to allow the same to be opened and closed, a conical headed press block 10 displaceably arranged on the fore part of the axial extension of the center rod 3 and an E-shaped control lever 11 for operatively controlling opening and closing of the nozzle 8.

More particularly, the rotary cylinder 1 is located at the rear end of the device and is telescopically fitted on the rear part of the stationary cylinder 4 in such a manner as to axially move thereon. The grip end cylinder 2 is located at the rearmost end of the device, of which one side is fixed to the rear end of the center rod 3 so that the top end thereof moves forwards, when pushing the grip end cylinder 2. The center rod 3 extending along the axle of the device consists of two parts, that is, a large diameter part at the rear side and a reduced diameter part at the fore side of the device. Further the free end A of the centre rod 3 is formed to the shape of an object to be driven such as screw, pin, rivet or the like. For instance, when driving a minus screw, the free end A of the center rod 3 has an I-shaped cross section, while it has a cross-shaped section in case that a plus screw is to be driven. A spring 5 is arranged between the press block 10 and the rear wall of the thrust sleeve 7. Further another spring 6 is arranged between the flange-shaped collar 13 of the center rod 3 and the bottom wall of the stationary cylinder 4 to urge the center rod 3 to move forwards.

Owing to the arrangement that the thrust sleeve 7 in the stationary cylinder 4 is formed with an inner tapered part round its front edge, the nozzle 8 on the press block 10 can be opened by way of swingiing movement of the upper and lower nozzle halves 8' and 8'' about a ring 14 located at the central part of the press block 10, said swinging movement being caused by engagement of the inclined rear parts of the nozzle halves 8' and 8'' to the aforesaid inner tapered part of the thrust sleeve 7.

Figure 5:
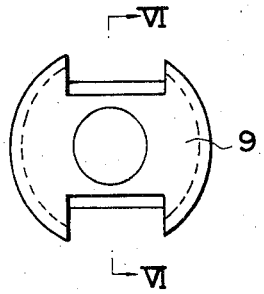
FIG. 5 is a front view of a support block incorporated in the nozzle.
Figure 6:
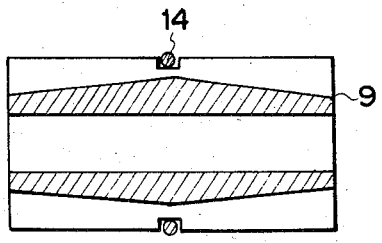
FIG. 6 is a sectional view of the support block in FIG. 5, taken in the longitudinal direction.

As shown in FIGS. 5 and 6, the support block 9 is formed with a pair of upper and lower grooves, each of which is axially extended to receive therein the corresponding nozzle half. Further, as best seen from FIG. 6, the axially extending grooves 8' and 8'' have a convexity respectively, of which highest point is located in alignment with the ring 14, whereby swinging movement of the the nozzle halves 8' and 8'' about the ring 14 is caused. This allow the nozzle 8 to be opened just like a bird's bill.

The E-shaped control lever 11 in the form of twin lever arms is pivotally arranged at the central lower part of the stationary cylinder 4. As readily seen from the drawings, the extreme end 15 of one of the lever arms is tapered inwards. Thus, when depressing the rear part of the control lever 11, the tapered end 15 of the lever arm becomes effective in displacing the thrust sleeve 7 forwards, whereby the front end of the thrust sleeve 7 comes in engagement to the nozzle halves 8' and 8'', causing the nozzle to be opened (see FIG. 2). In the meanwhile, the other lever arm of the E-shaped control lever 11 has an inner tapered end which is located opposite to the aforesaid tapered end 15. When depressing the fore part of the control lever 11, the tapered end 16 comes in engagement to the recess 17 formed on the thrust sleeve 7. Thus the thrust sleeve 7 is locked (see FIGS. 2 and 4). In order that the control lever 11 is restored to the horizontal location, a coil spring 12 is arranged about the lever arm at the rear side of the control lever 11. Further the stationary cylinder 4 is formed with apertures 18 and 18' through which the tapered ends 15 and 16 of the both lever arms are protruded toward the thrust sleeve 7.

Now operation of the device of the invention will be described below.

First, an operator depressed the E-shaped control lever 11 at its rear part, holding the both rotary cylinder 1 and stationary cylinder 4 by his hand. Thus the tapered end 15 of the control lever 11 comes in contact against the rear wall of the thrust sleeve 7 to displace the same forwards. This allows the tapered part of the thrust sleeve 7 to be engaged to the inclined rear ends of the nozzle halves 8' and 8'', where by they are operated swingingly about the ring 14 in the axial grooves of the support block 9, causing the nozzle 8 to be opened (see FIG. 2).

Next, the operator brings and locates a screw midst the opened nozzle halves 8' and 8'' and then returns the control lever 11 to the original position. Then the spring 5 becomes effective in displacing the trust sleeve 7 forwards, causing the both upper and lower nozzle halves 8' and 8'' to be disengaged from the tapered part of the thrust sleeve 7 and at the same time the conical headed press block 10 to move forwards to come in contact against the lower inclined parts of the nozzle halves 8' and 8''. As a result the nozzle halves 8' and 8'' are operated swinging about the ring 14 to pinch the screw at its head (see FIG. 3). Now the screw is ready to be driven. Since the screw is firmly held by means of the nozzle halves 8' and 8'', there is no fear that the screw falls down, when the operator locates it at any position in any direction.

Then the operator brings the device with the screw pinched by means of the nozzle 8 just in front of a threader hole into which the screw is to be driven and then exerts light pushing force on the grip end cylinder 2, while rotating the rotary cylinder 1. Thus the center rod 3 is displaced forwards and the free end A thereof comes in engagement to the recessed part of the screw head, whereby the screw is rotated and driven into the threaded hole of the workpiece. In this connection it is to be noted that as the center rod 3 moves forwards, the conical portion of the center rod 3 abuts against the rear wall of the thrust sleeve 7 and thereby the thrust sleeve 7 in turn moves forwards together with the center rod 3, whereby the inner tapered part of the thrust sleeve 7 at its front end comes in engagement to the rear inclined parts of the nozzle halves 8' and 8''. Thus the nozzle 8 becomes opened and results in disengagement from the screw head. Now the free end A of the center rod 3 can drive the screw. In the meanwhile, the control lever 11 is rotated in the clockwise direction by means of the coil spring 12, until the tapered end 16 thereof comes in engagement to the recess 17 on the thrust sleeve 7. Thus the thrust sleeve 7 is locked, ensuring that the nozzle 8 is kept open (see FIG. 4).

It is to be noted that when driving a screw, the operator pushes the grip end cylinder 2, while rotating the rotary cylinder 1, whereas he only pushes the grip end cylinder 2, when inserting a pin or rivet into a drilled hole.

Figure 7:
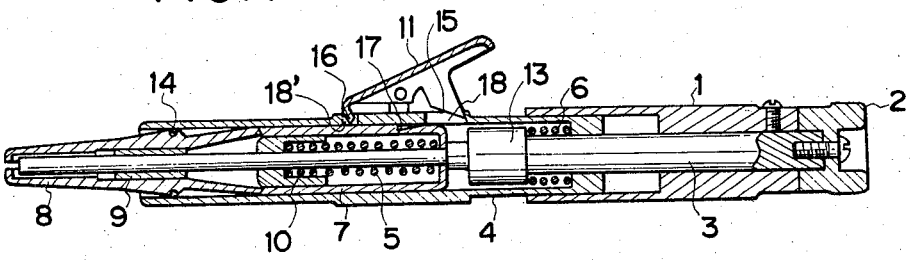
FIG. 7 is a sectional view of the device in accordance with a modified embodiment of the invention, taken in the longitudinal direction.

Next, FIG. 7 illustrates a device in accordance with another embodiment of the invention, modified from that in FIGS. 1 to 6. This modified embodiment of the invention has no substantial difference from that in FIGS. 1 to 6 in structure and consists in that the control lever 11 for actuating the thrust sleeve 7 is constructed in a different manner. Specifically, in the first mentioned embodiment of the invention in FIGS. 1 to 6 the control lever 11 has an E-shaped cross section, whereas in this modified embodiment the control lever 11 is formed in a triangular shape in cross section and has reaward extension from the upper inclined surface in order to widen a touching area for the operator's finger in view of easy operation of the control lever 11. Further the coil spring 12 on the rear lever arm is replaced with a coil spring (not shown) which is arranged about the pivotal pin in the modified embodiment.

As described above, the control lever 11 in accordance with the modified embodiment of the invention isn't substantially different from that in the first mentioned embodiment in structure only with the exception that its cross section is designed in a different shape and the spring means is located in a different position. Specifically, the control lever 11 is provided with a first lever arm 15 and second lever arm 16 in the same manner, each of which has a tapered free end, said first lever arm 15 serving to displace the thrust sleeve 7 forwards, which said second lever arm 16 serving to lock the same.

Since other parts and components in the modified embodiment have the same structure and function as those in the first mentioned embodiment, further repeated description will be not required.

The present invention has been described with respect to a screw driver in that way, but the invention shouldn't be limited only to it. It is obvious that the device may be employed for holding and driving a pin or rivet into a drilled hole by means of the free end of the center rod 3 made flat. Further the device may be applicable for the purpose of holding and screwing a nut onto a screw or bolt. Moreover it is possible to drive a nail into a ceiling with the use of the device which has an lengthened nozzle 8 and center rod 3. Hence it should be of course understood that the above described embodiments are mereby illustrative of the invention and that it may be changed or modified in a suitable manner without any departure from the spirit and scope of the invention.

What is claimed is:

1. A device for driving a screw, pin, rivet or the like comprising a stationary cylinder in the form of hollow cylinder;

a rotary cylinder to which a grip end cylinder is rotatably attached, said rotary cylinder being telescopically fitted on said stationary cylinder so that relative sliding and rotational movement are ensured therebetween;

a center rod with its one end secured to the rotary cylinder, having a flange-shaped collar at the middle part and a reduced diameter extension which is extended from said collar to the free end thereof;

a thrust sleeve axially displaceably arranged in front of the collar of the center rod in the stationary cylinder, said thrust sleeve being formed with an inner tapered part around its front edge and a locking recess in position on the outer surface thereof;

a conical headed press block axially displaceably arranged on the reduced diameter extension of the center rod in the thrust sleeve to move forwards by means of a spring means;

a nozzle consisting of a pair of upper and lower nozzle halves, each of which has an inclined rear part which is so formed as to come in engagement to the inner tapered part of the thrust sleeve at its outer side and to the conical headed part of the press block at its inner side;

a support block arranged on the fore part of the reduced diameter extension of the center rod to support the nozzle, siad support block being formed with upper and lower axially extending grooves in which the upper and lower nozzle halves are received to perform swinging movement over the convexity in the grooves; and a control lever in the form of twin lever arms having tapered ends and being pivotally arranged on the stationary cylinder, one of the lever arms extending through an aperture on the stationary cylinder to the thrust sleeve to displace the same forwards by means of its tapered end, while the other lever arm extending through another aperture on the stationary cylinder into said recess formed on the thrust sleeve to lock the same by means of its tapered end.

2. A device as set force in claim 1, wherein the upper and lower nozzle halves are made of a split tube in the form of semi-circle in cross section respectively.

3. A device as set forth in claim 1, wherein the control lever is formed in an E-shaped cross section and one of the lever arms thereof is provided with a spring means for return movement of the control lever to the original position.

4. A device as set forth in claim 1, wherein the control lever is formed in a triangular cross section and has a reaward extension from the upper inclined surface to widen a touching area for an operator's finger for easy operation of the control lever.

5. A device as set forth in claim 1, wherein the free end of the center rod is formed to the shape of a screw driver.

6. A device as set forth in claim 1, wherein the free end of the center rod is formed to flat end face against which a pin, rivet or the like abuts.

* * * * *